United States Patent [19]

Abys et al.

[11] Patent Number: 4,486,274

[45] Date of Patent: Dec. 4, 1984

[54] PALLADIUM PLATING PRODEDURE

[75] Inventors: Joseph A. Abys, Bridgewater; Harvey S. Trop, Morris Plains, both of N.J.

[73] Assignee: AT&T Bell Laboratories, Murray Hill, N.J.

[21] Appl. No.: 477,588

[22] Filed: Mar. 21, 1983

Related U.S. Application Data

[63] Continuation of Ser. No. 239,151, Feb. 27, 1981, abandoned.

[51] Int. Cl.[3] ..... C25D 3/52; C25D 3/56; C25D 3/58; C25D 3/64

[52] U.S. Cl. ..... 204/44; 204/43.1; 204/44.6; 204/47

[58] Field of Search ..... 204/47, 43 R, 43 N, 204/43 T, 44, 109, 123

[56] References Cited

U.S. PATENT DOCUMENTS

| | | | |
|---|---|---|---|
| 2,452,308 | 10/1948 | Lambros | 204/47 |
| 4,066,517 | 1/1978 | Stevens et al. | 204/43 N |
| 4,278,514 | 7/1981 | Morrissey | 204/47 |
| 4,339,311 | 7/1982 | Branik | 204/47 |

FOREIGN PATENT DOCUMENTS

| | | | |
|---|---|---|---|
| 2244437 | 3/1973 | Fed. Rep. of Germany | 204/43 N |
| 2360834 | 6/1975 | Fed. Rep. of Germany | 204/47 |
| 2506467 | 8/1976 | Fed. Rep. of Germany | 204/43 N |

*Primary Examiner*—G. L. Kaplan

*Attorney, Agent, or Firm*—Walter G. Nilsen

[57] ABSTRACT

A palladium electroplating procedure is disclosed which permits rapid and efficient plating and yields ductile, adherent palladium films. The electroplating bath comprises a unique palladium complex. The procedure is also useful for electroplating a variety of palladium alloys. In addition, the bath is highly stable and does not adversely affect the base material being plated.

24 Claims, 1 Drawing Figure

PALLADIUM PLATING PRODEDURE

This application is a continuation of application Ser. No. 239,151, filed Feb. 27, 1981 and now abandoned.

TECHNICAL FIELD

The invention is a process for electroplating palladium from an aqueous plating bath.

BACKGROUND OF THE INVENTION

Precious metals are used as protective films on surfaces for a variety of reasons. In the jewelry trade, it is used to improve the appearance of an article as in gold plated jewelry. In other applications, it is used to protect against corrosion of metals and other surface materials. In the electrical arts protective films made of precious metals are used as conduction paths in electrical circuits and as contact surfaces in devices with electrical contacts. Gold is used extensively in these applications with great success. However, the increased price of gold makes it attractive to look at other precious metals as protective films on various surfaces.

Palladium and palladium alloys are used extensively in a variety of industrial applications. Typical examples are the jewelry trade where such films are used to protect surfaces against corrosion and to improve appearance, in the electrical arts in various electrical devices and electronic circuits and in the optical field for various types of optical devices.

Because of chemical inertness and reasonable hardness, palladium is especially attractive as an electrical contact material in electrical connectors, relay contacts, switches, etc. Various palladium alloys such as palladium-silver, palladium-nickel, and palladium-copper are also useful for the same applications. Indeed, because of the increasing cost of gold, palladium and palladium alloys become more and more attractive economically as a contact material, surface material, and in other applications. In many applications where gold is now used, it is often economically attractive to use palladium, provided an inexpensive and efficient method of plating ductile and adherent palladium is available.

Highly desirable is a process for plating palladium from an aqueous solution which is rapid and yields palladium and palladium-alloy films which are ductile, adherent and free from hydrogen. Further, it is desirable to have a palladium electroplating process which does not require subsequent heat treatment to remove hydrogen, improve ductility or adherence. In many applications, it is desirable that the palladium plating bath not chemically attack the surface being plated so that the bath remains uncontaminated during the plating process. Palladium plating processes have been described in a number of references including U.S. Pat. No. 1,970,950, issued to E. M. Wise on Aug. 21, 1934; U.S. Pat. No. 1,993,623, issued to A. R. Raper on Mar. 5, 1935; and U.S. Pat. No. 3,290,234, issued to E. A. Parker et al on Dec. 6, 1966. Ethylenediamine has been used in a palladium alloy plating procedure (U.S.S.R. Pat. No. 519,497 issued June 30, 1976); (C. A. 85: 113802m) and it was known to the inventors that ethylenediamine is useful in palladium electroplating in the following composition bath: 28 gm/l $PdCl_2$, 140 gm/l $Na_2SO_4$ and sufficient ethylenediamine to dissolve the $PdCl_2$. The bath is used at room temperature, the current density is 20 mA/cm$^2$ and the pH between 11 and 12.

SUMMARY OF THE INVENTION

The invention is a process for electroplating palladium (both pure metal and alloys with various metals) from an aqueous plating solution in which the plating solution comprises palladium in the form of a complex ion and the complexing agent is one or more organic aliphatic polyamines with from three to 20 carbon atoms. Both straight chain and branch chain aliphatic groups may be attached to the amine groups. Typical complexing agents are diaminopropane (particularly 1,3-diaminopropane), diethylenetriamine, 1,4-diaminobutane, 1,6-diaminohexane, etc. Secondary polyamines such as N,N' dimethyl-1,3-propanediamine and tertiary polyamines such as N,N,N'N' tetramethylethylenediamine are also useful provided the total number of carbon atoms does not exceed 20. A limited number of substituents are also useful, such as hydroxy groups (i.e., 2-hydroxy-1,3-diaminopropane) and halogen groups such as chloride and bromide. It is preferred that the aqueous electroplating bath be alkaline (pH greater than 7.0) to avoid corrosion of the surface being plated and sufficiently conductive to allow plating (generally greater than $10^{-3}$ mho-cm). Additional substances may be added to the palladium plating bath to control and adjust pH (such as a buffer), to increase conductivity and to improve the properties of the plated metal. Typical substances used to improve the plated metal are lactones (i.e., phenolphthalein, phenolsulfonephthalein, etc.), lactams, cyclic sulfate esters, cyclic imides and cyclic oxazolinones. Certain polyalkoxylated alkylphenols may also be useful. The process is also useful for plating certain palladium alloys including 10 mole percent palladium, remainder copper, nickel and/or silver.

DETAILED DESCRIPTION

Figure 1:
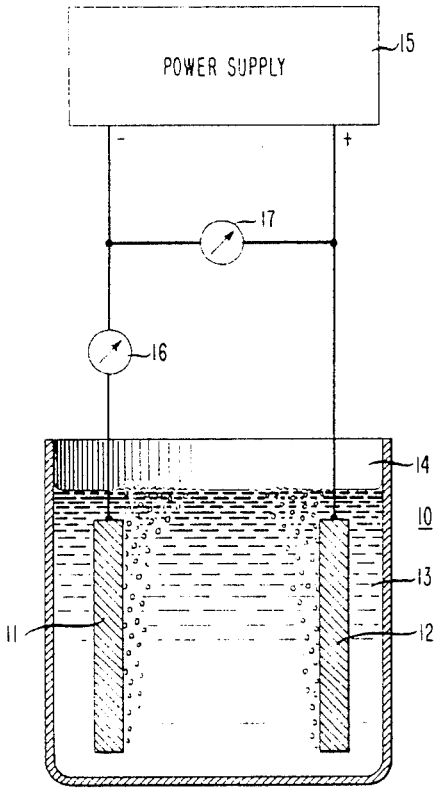
FIG. 1 shows a typical apparatus useful in electroplating palladium and palladium alloys in accordance with the invention.

The invention is a process for electroplating palladium metal or palladium alloy in which a certain class of organic aliphatic polyamines is used as complexing agent in the palladium plating bath. Most useful are aliphatic polyamines with from three to 20 carbon atoms. Complexing agents with less than three carbon atoms yield useful results but tend to evaporate and limit the lifetime of the bath. Complexing agents with more than 20 carbon atoms usually have limited solubility in aqueous solutions. Aromatic polyamines are also useful but often are difficult to work with (often poisonous with undesirable odor). Most preferred are the complexing agents 1,3-diaminopropane and diethylenetriamine because of the excellent quality of the palladium plating obtained, especially at high plating current density (above 50 ASF). In addition, the conditions (pH, temperature, etc.) under which optimum plating occurs with these preferred complexing agents permits rapid plating without incorporation or evolution of hydrogen. Also, undesirable chemical attack on the surface being plated is minimal or insignificant under optimum conditions of plating with these complexing agents.

Within the limitations set forth above, the structure of the complexing agent may vary considerably. In particular, these complexing agents may contain certain substituents which do not significantly alter their complexing properties but may increase solubility, stability, electrochemical reduction (or oxidation) potential, etc. Typical substituents are hydroxyl groups, chloride and bromide. The complexing agents should be stable to the conditions of the electroplating process and in particular not undergo oxidation or reduction under the conditions of the electroplating process. For example, carboxylic acid groups should be avoided because such substituted aliphatic polyamines are generally not electrochemically stable. Also, the reduction potential is more noble such that their electrochemical reduction occurs along with hydrogen.

Often the choice of a particular polyamine complexing agent depends on electrochemical stability. It is often advantageous to have a reduction potential far removed from the reduction potential of water so that even at high plating rates, hydrogen is not liberated as palladium is electroplated.

Alloy plating may also be carried out using the polyamine complexing agent. Typical elements alloyed with palladium are silver, copper, nickel, cobalt, iron, gold, chromium, manganese, ruthenium, rhodium, platinum and iridium. Particularly useful are copper, nickel and silver. Preferred are alloys comprising at least 10 mole percent palladium, remainder copper, silver and/or nickel. Other useful alloys are 60 mole percent palladium, remainder silver, copper and/or nickel, 40 mole percent palladium, remainder silver, copper and/or nickel, etc. The palladium-silver alloys are particularly useful, especially for electrical contact surfaces.

A large variety of counter ions (anions) may be used in the electroplating bath provided the anions are stable (chemically and electrochemically) and in particular are not subject to oxidation or reduction under conditions of the electroplating process. In addition, the anion should not interfere with the plating process by either chemical attack on the surface being plated or on the metal complex system. Typical anions are halides, nitrate, sulfate and phosphates. Chloride ion is preferred because of the low cost of palladium chloride and the stability of the chloride ion under conditions of the electroplating process. Also, certain ions, including those set forth above, may be used as supporting electrolyte to increase conductivity of the electroplating bath. The cation used for the supporting electrolyte may be any soluble ion which does not interfere with the electroplating process. Alkali-metal ions (Na, K, Li) are particularly preferred because of solubility and stability.

Various compounds may be used as a source of palladium. Palladium chloride is preferred because of availability and stability. Also, useful are compounds yielding tetrachloropalladate ion in aqueous solution such as alkali-metal tetrachloropalladate (i.e., $K_2PdCl_4$). These compounds may be used initially to make the bath and to replenish the bath.

Particular advantages of the electroplating bath using organic aliphatic polyamines as complexing agent are the improved conditions of plating which reduce chemical attack on the surface being plated, avoid production of hydrogen even at high plating rates (even above 200 or even 500 ASF) and improved the quality of plating even at very high plating rates. For example, the pH of the bath may vary over large limits, but generally alkaline aqueous solution is preferred (typically pH from 7.5 to 13.5) with the range from 11.0 to 12.5 preferred. The preference particularly applies when the preferred polyamines are used, namely 1,3-diaminopropane and diethylenetriamine. Within the pH range, very rapid plating can be carried out with excellent plating results. Generally, a bath composition which permits rapid plating with more alkaline solution is preferred because of decreased attack on the surface being plated and decreased chances of hydrogen evolution.

The plating process may be carried out with or without a buffer system. A buffer system is often preferred because it maintains constant pH and adds to the conductivity of the bath. Typical buffer systems are the phosphate system, borax, bicarbonate, etc. Preferred is the $HPO_4^{-2}/PO_4^{-3}$ system often made by adding an alkali-metal hydroxide (KOH,NaOH, etc.) to an aqueous solution of the hydrogen phosphate ion. Generally, the concentration of buffer varies from about 0.1 Molar to 2 Molar (about 1.0±0.2 Molar preferred) and the mole ratio of hydrogen phosphate to phosphate varies from 5/1 to 1/5 (with equal mole amounts within ±50 percent preferred). These mole ratios often depend on the particular pH desired for the plating bath.

The bath temperature may vary over large limits, typically from the freezing point to the boiling point of the electroplating bath. Often, the preferred plating temperature range depends on bath composition and concentration, plating cell design, pH and plating rate. Preferred temperatures for typical conditions are from room temperature to about 80 degrees C. with 40 to 60 degrees C. most preferred.

Various surfaces may be plated using the disclosed process. Usually, the plating would be carried out on a metal surface or alloy surface, but any conducting surface would appear sufficient. Also, electrolessly plated surfaces may be useful. Typical metal and alloy surfaces are copper, nickel, gold, platinum, palladium (as, for example, a surface electrolessly plated with palladium and then electroplated with palladium in accordance with the invention). Various alloy surfaces may also be used such as copper-nickel-tin alloys.

The composition of the bath may vary over large limits provided it contains a source of palladium and significant amounts of one or more polyamines of the class set forth above. In general, sufficient polyamine should be present to complex with the palladium. Usually, it is advantageous if excess polyamine is present in the bath solution.

The palladium concentration in the bath typically varies from 0.01 Molar to saturation. Preferred concentrations often depend on plating rate, cell geometry, agitation, etc. Typical preferred palladium concentration ranges for high-speed plating (50 to 1000 ASF) are higher than for low-speed plating (up to 50 ASF). Preferred palladium concentration ranges for high-speed plating vary from 0.1 to 1.0 Molar. For low-speed plating, the preferred range is from 0.05 to 0.2 Molar. Where palladium alloy plating is included, the alloy metal (usually copper, silver or nickel) replaces part of the palladium in the composition of the plating bath. Up to 90 mole percent of palladium may be replaced by alloy metal.

The amount of complexing agent (polyamine) may vary over large limits, typically from 0.5 times (on the basis of moles) the concentration of the palladium species to saturation of the complexing agent. Generally, it is preferred to have excess complexing agent, typically from two times to 12 times the mole concentration of the palladium species. Most preferred is about six times the mole concentration of palladium. The preferred ranges of complexing agent in terms of palladium species are the same for high-speed and low-speed baths.

The concentration of buffer may vary over large limits. Such concentrations often depend on cell design, plating rates, etc. Typically, the buffer concentration varies from 0.1 Molar to saturation with from 0.2 to 2.0 Molar preferred.

The bath may be prepared in a variety of ways well known in the art. A typical preparation procedure which yields excellent result is set forth below: Equal volumes (142 mls) of 1,3-diaminopropane and water are mixed in a beaker. Heat of solution is sufficient to heat the resulting solution to about 60 degrees C. To this solution with vigorous stirring are added 50 gms of $PdCl_2$ in portions of 0.5 gms every two minutes. Since the resulting reaction is exothermic, the solution can be maintained at 60 degrees C. by adjusting the rate of addition of $PdCl_2$. The solution is filtered to remove solid matter (generally undissolved $PdCl_2$ or PdO) and diluted to one liter.

To this solution are added 127 gms of $K_3PO_4$ and 70 gms of $K_2HPO_4$. The pH is 12.3 at 25 degrees C. and can be adjusted upward by the addition of KOH and downward by the addition of $H_3PO_4$.

Electroplating experiments are carried out in an electroplating cell provided with means for high agitation. Temperature is maintained between 50 and 65 degrees C., 55 degrees preferred. Current is passed through anode, electroplating bath and cathode. The electrical energy is supplied by a conventional power supply. The current density is 175 ASF. Typical thicknesses in these experiments are 40 to 150 microinches. The deposit is crack free as determined by a scanning electron micrograph at 10,000 magnification. Both adherence and ductility are excellent. Similar results are obtained using 0.1 Molar palladium and 0.5 Molar palladium. Plating rate is often determined by the thickness desired after a predetermined period of plating. For example, in a strip line plating apparatus (see, for example, U.S. Pat. No. 4,153,523 issued to D. E. Koontz and D. R. Turner on May 8, 1979 and U.S. Pat. No. 4,230,538 issued to D. R. Turner on Oct. 28, 1980) the strip line being plated is exposed to the plating solution for a set period of time (depending on the speed the strip is moving down the line and the length of the plating cell) and the plating rate is adjusted to give the desired thickness in this period of time. Similar results are obtained with diethylenetriamine. Experiments carried out with 2 hydroxypropanediamine, 1,4-diaminobutane, 1,5-diaminopentane and 1,6-diaminohexane yield similar results.

Similar results are obtained with low-speed baths. Here the preparation procedure is exactly the same except the quantity of reagents are different. A typical bath contains 16.66 gms $PdCl_2$, 42 gms polyamine complexing agent, 42 gms $K_3PO_4$, 139 gms $K_2HPO_4$ and sufficient water to make one liter. The preparation procedure is exactly the same as above. The pH is about 10.8 at 55 degrees C. and plating is carried out in the temperature range from 50 to 65 degrees C. Typical slow plating rates are about 10 ASF.

Similar experiments were carried out on the following bath compositions:

EXAMPLE 1

13.3 gm/l $PdCl_2$, 15.5 gm/l diethylenetriamine and phosphate buffer. Electroplating was carried out at 55 degrees C. on a copper substrate.

EXAMPLE 2

6.67 gm/l $PdCl_2$, 12.0 gm/l 1,6-hexadiamine and phosphate buffer. Electroplating was carried out at 55 degrees C. on a copper substrate.

EXAMPLE 3

6.67 gm/l $Pd(NO_3)_2$, 12.0 gm/l 1,6-hexadiamine and phosphate buffer. Electroplating was carried out at 55 degrees C. on a copper substrate

EXAMPLE 4

12.0 gm/l $PdCl_2$, 18.0 gm/l 1,4-butadiamine and phosphate buffer. Same as above.

EXAMPLE 5

0.05 Molar $Pd(NO_3)_2$, 0.1 Molar diethylenetriamine, no buffer, 0.4 Molar $KNO_3$. The pH was varied by the addition of KOH from 10 to 14, temperature from 20 degrees C. to 70 degrees C.

EXAMPLE 6

0.1201 Molar $Pd(NO_3)_2$, 3.2 Molar diethylenetriamine, 0.5 Molar $KNO_3$, no buffer. The pH was varied from 12 to 14 by addition of NaOH. Temperature was about 65 degrees C.

EXAMPLE 7

0.02097 Molar $PdSO_4.2H_2O$, 0.1 Molar diethylenetriamine, 0.419 Molar $Na_2SO_4$. The pH range was varied from 10.2 to 13.5 by addition of NaOH, temperature varied from 20 degrees C. to 70 degrees C.

EXAMPLE 8

0.052 Molar $PdCl_2$, 0.4 Molar 1,4-diaminobutane, $Na_2SO_4$ and NaCl as supporting electrolyte, no buffer. Electroplated at 43 ASF to 138 microinches on copper. Deposit is bright and adherent. Repeat as 65 ASF to 138 microinches.

EXAMPLE 9

0.11 Molar $PdSO_4.2H_2O$, 0.97 Molar diethylenetriamine, 1 Molar $KNO_3$ as supporting electrolyte and NaOH to pH of 12.5. Temperature 65 to 70 degrees C., high agitation, plated at rates 152 ASF, 196 ASF, 239 ASF, 272 ASF and 300 ASF to a thickness of 138 microinches. Excellent brightness and adherence. On adding more $PdSO_4.2H_2O$, went to plating rate of 552 ASF.

EXAMPLE 10

0.027 Molar $Pd(NO_3)_2.2H_2O$, 0.10 Molar 1,3-diaminopropane, no buffer, pH varied from 11.2 to 13.0.

EXAMPLE 11

0.054 Molar $Pd(NO_3)_2.2H_2O$, 0.2 Molar diethylenetriamine, phosphate buffer, pH adjusted to 13 with NaOH, temperature of 55 degrees C. Electroplated on Pt, Pd and Au.

EXAMPLE 12

0.282 Molar $PdCl_2$, 0.7 Molar 1,3-diaminopropane, 75 gm/l $Na_2SO_4$ supporting electrolyte, 12.5 gm/l $K_2HPO_4$ buffer. Electroplated on both gold and copper surfaces at 60 to 65 degrees C., pH of 12.5 at 150 ASF, 200 ASF, 250 ASF, 300 ASF, 400 ASF, 500 ASF. All deposits were adherent and bright to semibright.

EXAMPLE 13

10 gm/l $Pd(NO_3)_2.2H_2O$, 6 gm/l 1,3-diaminopropane.

EXAMPLE 14

60 gm/l $PdCl_2$, 75.2 gm/l 1,3-diaminopropane, 175 gm/l $K_2HPO_4$, pH adjusted with NaOH to pH of 11.0, temperature of 65 to 70 degrees C. Electroplated at rates of 150 ASF, 200 ASF, 300 ASF, 400 ASF, 500 ASF, 600 ASF, 700 ASF, 800 ASF, 900 ASF and 1000 ASF.

EXAMPLE 15

Same as above except 100 gm/l $K_3PO_4$ (instead of $K_2HPO_4$) and the pH was 11.4.

EXAMPLE 16

Same as above, but pH was 12.4, plating rate 150 ASF.

EXAMPLE 17

127.5 gm/l $PdCl_2$, 214 gm/l 1,3-diamine propane, 104.5 gm/l $K_2HPO_4$, 84.9 gm/l $K_3PO_4$, initial pH was 11.7 at 25 degrees C., adjust with NaOH to 12.0 at 25 degrees C. Electroplated at 60 to 65 degrees at 50 ASF, 150 ASF, 250 ASF and 500 ASF.

Palladium alloys may also be electroplated in accordance with the invention. A typical bath composition for palladium alloy plating is as follows: 69.6 gms $Ag_2O$, 53.2 gms $PdCl_2$, 222 gms 1,3-diaminopropane, 106.2 gms $K_3PO_4$, 86.5 gms $K_2HPO_4$ and water to one liter. The pH of the bath is adjusted to 11.3 by the addition of KOH or $H_3PO_4$. The bath temperature is maintained between 40 and 65 degrees C. and current density between 1 and 500 ASF. The other polyamine complexing agents mentioned above are also useful, including diethylenetriamine. A useful bath for palladium-nickel plating is as follows: 38.9 gms $NiCl_2$, 53.2 gms $PdCl_2$, 222 gms 1,3-diaminopropane, 106 gms $K_3PO_4$, 86.5 gms $K_2HPO_4$ and water to one liter. Preferred operating temperature is from 40 to 65 degrees C., pH is about 12 and current density from 1 to 500 ASF. Experiments were also done with cobalt salt added to the bath.

The apparatus described in the above-cited patents are particularly advantageous for carrying out the process. They permit good control of the bath conditions, the rate of plating and permit rapid palladium plating. The palladium plating process is highly advantageous for plating electrical contact pins for electrical connectors such as described in the above references.

FIG. 1 shows apparatus 10 useful in the practice of the invention. The surface to be plated 11 is made the cathode in the electrolytic process. The anode 12 is conveniently made of platinized titanium or may be made of various other materials such as oxides of platinum group metals, binder metal oxides, etc. Both anode and cathode are partially immersed in the electroplating bath 13 containing source of palladium complex with an organic aliphatic polyamine. A container is used to hold the palladium plating solution and the anode 12 and cathode 11 are electrically connected to source of electrical energy 15. An ammeter 16 and voltmeter 17 are used to monitor current and voltage. The voltage and current are controlled inside the source of electrical energy 15.

What is claimed is:

1. A process for electroplating a metallic substance on a surface, said metallic substance consists essentially of at least 10 mole percent palladium, remainder selected from the group consisting of silver, copper and nickel, comprising the step of passing current through a cathode, an electroplating bath and an anode with a cathode potential great enough to electroplate palladium, said electrochemical bath having a conductivity greater than a $10^{-3}$ mho-cm and a pH between 7.5 and 13.5, characterized in that the electroplating bath comprises an aqueous solution of palladium-aliphatic polyamine complex in which the aliphatic polyamine is selected from the group consisting of diaminopropane (including 1,3-diaminopropane), 1,4-diaminobutane, 1,6-diaminohexane, N,N,N',N'-tetramethyl-ethylenediamine and 2-hydroxy-1,3-diaminopropane.

2. The process of claim 1 in which the metallic substance consists essentially of palladium.

3. The process of claim 1 in which the aliphatic polyamine is 1,3-diaminopropane.

4. The process of claim 1 in which the pH varies from 11.0 to 12.5.

5. The process of claim 1 in which the electroplating bath comprises a buffer.

6. The process of claim 5 in which the buffer comprises hydrogen phosphate ion and phosphate ion.

7. The process of claim 6 in which the buffer concentration varies from 0.1 to 2 Molar and the ratio of hydrogen phosphate to phosphate ion is from 5/1 to 1/5.

8. The process of claim 1 in which the electroplating process is carried out at a temperature between room temperature and 80 degrees C.

9. The process of claim 8 in which the temperature is between 40 and 60 degrees C.

10. The process of claim 1 in which the palladium concentration is from 0.01 Molar to saturation.

11. The process of claim 10 in which the palladium is from 0.05 to 1.0 Molar.

12. The process of claim 1 in which the molar concentration of aliphatic polyamine is from 0.5 times the molar concentration of palladium to saturation of the aliphatic polyamine.

13. The process of claim 12 in which the concentration of aliphatic polyamine is from two to 12 times the mole concentration of palladium.

14. The process of claim 1 in which the plating current density is between 50 and 1000 ASF.

15. The process of claim 1 in which the palladium in the electroplating bath is replenished by the addition of a source of palladium.

16. The process of claim 15 in which the source of palladium is palladium chloride.

17. The process of claim 15 in which the source of palladium is a source of tetrachloropalladate ion.

18. The process of claim 1 in which the plating current density is up to 50 ASF.

19. A process for electroplating a metallic substance on a surface, said metallic substance consisting essentially of at least 10 mole percent palladium remainder selected from the group consisting of silver, copper and nickel, comprising the step of passing current through a cathode, an electroplating bath and an anode with a cathode potential great enough to electroplate palladium, said electrochemical bath having a conductivity greater than $10^{-3}$ mho-cm and a pH between 7.5 and 13.5, characterized in that the electrochemical bath comprises an aqueous solution of palladium-aliphatic polyamine complex, said complex the same as results from reacting a source of palladium with at least one aliphatic polyamine selected from the group consisting of diaminopropane (including 1,3-diaminopropane), 1,4-diaminobutane, 1,6-diaminohexane, N,N,N',N'-tetramethylethylene diamine and 2-hydroxy-1,3-diaminopropane.

20. The process of claim 19 in which the source of palladium is palladium chloride.

21. The process of claim 19 in which the aliphatic polyamine is 1,3-diaminopropane.

22. The process of claim 19 in which the metallic substance consists essentially of palladium.

23. A process for electroplating a metallic substance on a surface, said metallic substance consists essentially of at least 10 mole percent palladium, remainder selected from the group consisting of silver, copper and nickel, comprising the step of passing current through a cathode, an electroplating bath and an anode with a cathode potential great enough to electroplate palladium, said electrochemical bath having a conductivity greater than $10^{-3}$ mho-cm and a pH between 7.5 and 13.5, characterized in that the electroplating bath comprises an aqueous solution of palladium-aliphatic polyamine complex in which the aliphatic polyamine is diethylenetriamine and the molar concentration of diethylenetriamine is from 0.5 times the molar concentration of palladium to saturation of the diethylenetriamine.

24. A process for electroplating a metallic substance consisting essentially of at least 10 mole percent palladium remainder selected from the group consisting of silver, copper and nickel, comprising the step of passing current through a cathode, an electroplating bath and an anode with a cathode potential great enough to electroplate palladium, said electrochemical bath having a conductivity greater than $10^{-3}$ mho-cm and a pH between 7.5 and 13.5, characterized in that the electrochemical bath comprises an aqueous solution of palladium-aliphatic polyamine complex, said complex the same as results from reacting a source of palladium with diethylenetriamine and the molar concentration of diethylenetriamine is from 0.5 times the molar concentration of palladium to saturation of diethylenetriamine.

* * * * *